US005811165A

United States Patent [19]

Andréen

[11] Patent Number: 5,811,165

[45] Date of Patent: Sep. 22, 1998

[54] FLOOR MAT ARRANGEMENT

[75] Inventor: Gunnar Andréen, Lund, Sweden

[73] Assignee: S. Berendsen AB, Malmo, Sweden

[21] Appl. No.: 648,073

[22] PCT Filed: Nov. 15, 1994

[86] PCT No.: PCT/SE94/01070

§ 371 Date: Jul. 11, 1996

§ 102(e) Date: Jul. 11, 1996

[87] PCT Pub. No.: WO95/13731

PCT Pub. Date: May 26, 1995

[30] Foreign Application Priority Data

Nov. 15, 1993 [SE] Sweden ..... 9303756

[51] Int. Cl.[6] ..... B32B 3/06

[52] U.S. Cl. ..... 428/52; 428/85; 428/95; 428/99; 428/100; 15/217

[58] Field of Search ..... 428/99, 100, 85, 428/95, 44, 52; 15/215, 216, 217

[56] References Cited

U.S. PATENT DOCUMENTS 3,574,019 4/1971 Girard ..... 428/100

4,755,401 7/1988 Friedrich et al. ..... 428/100

FOREIGN PATENT DOCUMENTS

| | | |
|---|---|---|
| 0499474 | 8/1992 | European Pat. Off. . |
| 0556967 | 8/1993 | European Pat. Off. . |
| 2373306 | 7/1978 | France . |
| 343730 | 6/1919 | Germany . |
| 2803006 | 8/1979 | Germany . |
| 8601247 | 2/1986 | WIPO . |

*Primary Examiner*—Alexander Thomas
*Attorney, Agent, or Firm*—Beveridge, Degrandi, Weilacher & Young, LLP

[57] ABSTRACT

Floor mat arrangement for floor mats which have a (synthetic) rubber backing and a pile surface whose pile portion is surrounded by a pile-free border. The arrangement comprises at least two mats whose lower side, in or adjacent the corners of the mats, first Velcro strips or the like are attached. The arrangement further comprises second Velcro straps or strips or the like having opposite fastening means, linking together the first Velcro strips or patches of adjoining mats, arranged edge-to-edge. The back of the mats if formed with a patterned depression of a considerable extent.

8 Claims, 1 Drawing Sheet

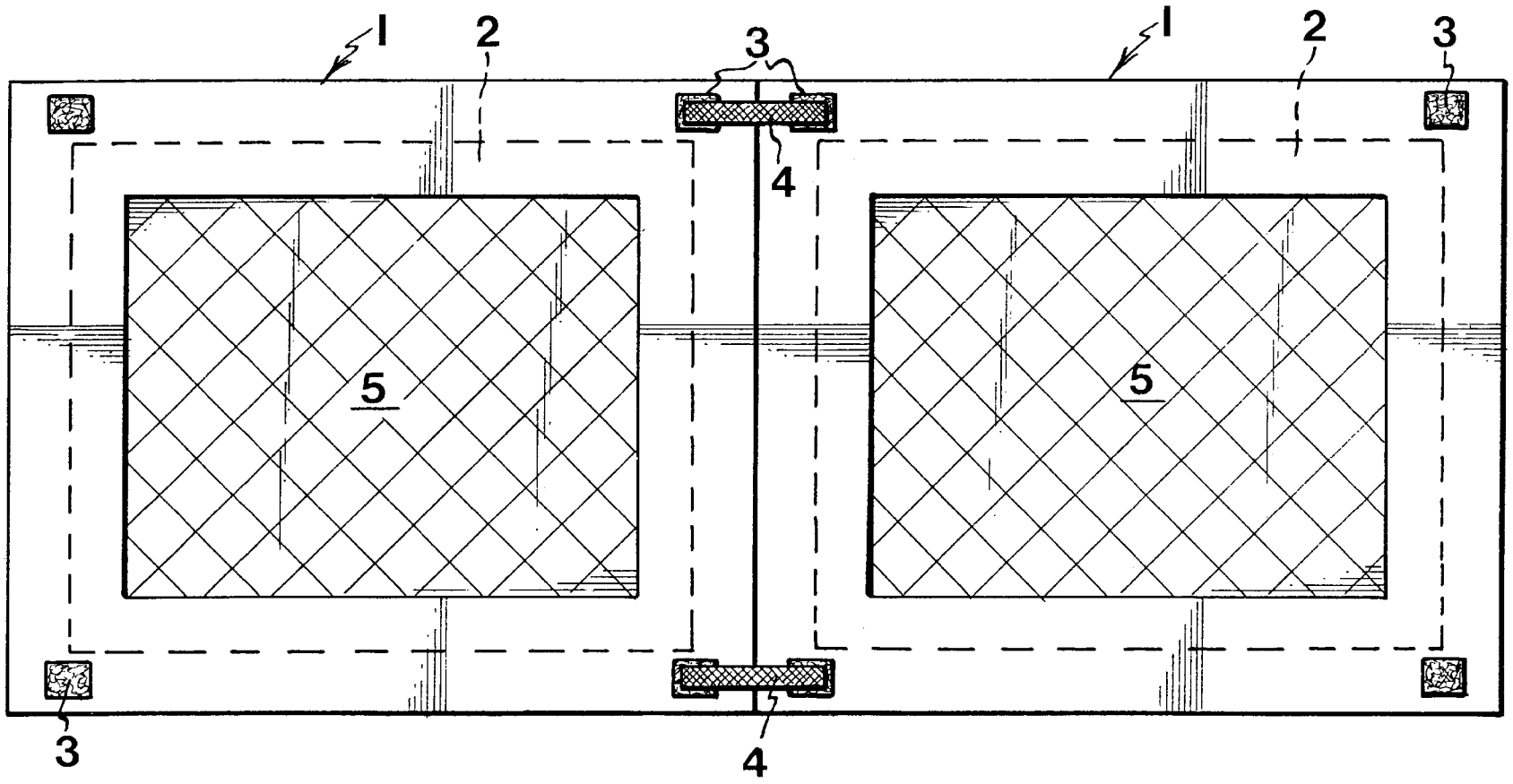
3
2
1
5
3
4
4
2
1
5
3

FLOOR MAT ARRANGEMENT

The present invention relates to a floor mat arrangement.

It is usual for companies to by doormats or entrance mats which have the approximate dimensions 1×2 m, and in which fibres are locked by a (synthetic) rubber backing. These fibres form a picture, e.g. a company logo or a pattern. It has been found that it is often desired to let such mats lie close to each other, edge-to-edge, thereby forming a larger mat in which the pictures or patterns fit together. One difficulty is that the mats creep on the base, the floor.

The invention according to the claim overcomes this difficulty.

Owing to the joining of the mats, a large mat is obtained which is more difficult to move on the base, the floor, and the depressions make gravel, which would cause sliding of the mat, collect inside their edges.

BRIEF DESCRIPTION OF THE DRAWING

The drawing shows a floor mat arrangement according to the present invention.

The drawing illustrates two equally large mats 1 of the current type, the pile surface facing away from the viewer. The image or pattern 2 formed by the pile is surrounded by a pile-free border. In each corner of the back of these mats, a strip 3 of Velcro material or the like is attached, for example by gluing. In adjoining corners of neighbouring floor mats, arranged edge-to-edge, such strips 3 are liked together by means of Velcro strips 4 or the like whose fastening means (e.g. loops/hooks) are of a type opposite those of the strips 3.

The mats have a patterned depression 5 of a considerable extent, which forms pockets for collecting gravel which may be found on the floor. These depressions have been formed in, for example, the manufacture of the backing of the mat.

Of course, an arbitrary number of mats may be included in the arrangement according to the invention.

I claim:

1. A floor mat arrangement, comprising:

floor mats each have a base which supports a pile portion and said base including a pile-free border surrounding the pile portion, said floor mats in said arrangement further comprising patches of hook and loop fastener material secured to a lower side of said mats, in or adjacent corners of each mat, and said floor mat arrangement further comprising hook and loop fastener strips which extend from patches of a respective one of said mats to an adjacent hook and loop patch of an adjoining one of said mats such that the adjoining floor mats are retained in an edge-to-edge relationship, and a back of said floor mats is formed with a patterned depression.

2. A floor mat arrangement as recited in claim 1 wherein said base is formed of a rubber material.

3. A floor mat arrangement as recited in claim 1 wherein said hook and loop fastener strips are elongated in a first direction and said strips are attached to said patches at free ends spaced apart along said first direction of the elongated strips such that the strips extend across adjoined edges of said mats and in an opposite direction to a direction of elongation of said adjoined edges.

4. A floor mat arrangement as recited in claim 1 wherein said pile-free border portion of said mats surrounds the patterned depressions in said mat.

5. A floor mat arrangement, comprising:

a first mat having a base which supports a pile portion and said base having a pile-free border surrounding the pile portion, said first mat including four corners, and said first mat further comprising hook and loop fastener patches positioned at or adjacent to said four corners and on a lower side of said first mat, said lower side also comprising a patterned depression;

a second mat having a base which supports a pile portion and said second mat also including a pile free border surrounding the pile portion of said second mat, said second mat including four corners, and said second mat further comprising hook and loop fastener patches positioned at or adjacent to the four corners and on a lower side of said second mat, said lower side of said second mat also comprising a patterned depression; and said first and second mats having adjoining edges with first and second juxtaposed pairs of said patches positioned on corresponding, adjoining corners of said first and second mats;

said floor mat arrangement further comprising a first hook and loop fastener strip which extends between said first juxtaposed pair of said patches and is secured to said patches at its free ends; and said floor mat arrangement further comprising a second hook and loop fastener strap which extends between said second juxtaposed pair of hook and loop fastener patches and is secured thereto at its free ends such that the adjoining floor mats are retained in an edge-to-edge relationship by said first and second hook and loop fastener straps.

6. A floor mat arrangement as recited in claim 5 wherein said base of said first and second mats is formed of a rubber material.

7. A floor mat arrangement as recited in claim 5 wherein said first and second straps extend across adjoined edges of said first and second mats and in an opposite direction to a direction of elongation of said adjoined edges.

8. A floor mat arrangement as recited in claim 5 wherein said pile-free border portions of said first and second mats surround inwardly positioned pile portions of said first and second mats.

* * * * *